US011708242B2

(12) United States Patent
Kondo et al.

(10) Patent No.: US 11,708,242 B2
(45) Date of Patent: Jul. 25, 2023

(54) CONTROL SYSTEM FOR ELEVATOR

(71) Applicant: Hitachi, Ltd., Tokyo (JP)

(72) Inventors: Takeshi Kondo, Tokyo (JP); Shinsuke Inoue, Tokyo (JP); Naoaki Noguchi, Tokyo (JP)

(73) Assignee: HITACHI, LTD., Tokyo (JP)

( * ) Notice: Subject to any disclaimer, the term of this patent is extended or adjusted under 35 U.S.C. 154(b) by 212 days.

(21) Appl. No.: 17/283,339

(22) PCT Filed: Sep. 24, 2019

(86) PCT No.: PCT/JP2019/037219
§ 371 (c)(1),
(2) Date: Apr. 7, 2021

(87) PCT Pub. No.: WO2020/090286
PCT Pub. Date: May 7, 2020

(65) Prior Publication Data

US 2022/0002114 A1 Jan. 6, 2022

(30) Foreign Application Priority Data

Oct. 30, 2018 (JP) ..... 2018-203721

(51) Int. Cl.
*B66B 5/06* (2006.01)

(52) U.S. Cl.
CPC ..... *B66B 5/06* (2013.01)

(58) Field of Classification Search
CPC ..... B66B 1/32; B66B 5/02; B66B 5/0031; B66B 5/18; B66B 5/04; B66B 5/16;
(Continued)

(56) References Cited

U.S. PATENT DOCUMENTS

2006/0289241 A1 12/2006 Okamoto et al.
2015/0014098 A1 1/2015 Stölzl et al.

FOREIGN PATENT DOCUMENTS

CN 101301977 A * 11/2008 ..... B66B 1/32
CN 103663033 B * 5/2016
(Continued)

OTHER PUBLICATIONS

International Search Report of PCT/JP2019/037219 dated Nov. 5, 2019.

*Primary Examiner* — Marlon T Fletcher
(74) *Attorney, Agent, or Firm* — Mattingly & Malur, PC

(57) ABSTRACT

A control system for an elevator includes a first car speed detection device and a second car speed detection device to measure a moving speed of the car, a hoist brake to apply braking to the hoist, emergency stop equipment to brake the car by grasping guide rails, and a control device to control the hoist, the hoist brake, and the emergency stop equipment based on outputs of the first car speed detection device and the second car speed detection device. If two pieces of velocity data that have been output from the first car speed detection device and the second car speed detection device respectively differ from one another and acceleration data of the car calculated from one that is higher of the two pieces of velocity data is equal to or more than a predetermined threshold, the control device decides if either car speed detection device is abnormal.

6 Claims, 3 Drawing Sheets

(58) Field of Classification Search
CPC ..... B66B 5/0037; B66B 1/36; B66B 5/0018; B66B 5/021; B66B 11/08; B66B 5/06
See application file for complete search history.

(56) References Cited

FOREIGN PATENT DOCUMENTS

| | | | | | |
|---|---|---|---|---|---|
| CN | 107848747 | A | * | 3/2018 | ..... B66B 1/04 |
| DE | 112014007092 | T5 | * | 8/2017 | ..... B66B 1/28 |
| EP | 2206672 | A2 | * | 7/2010 | ..... B66B 5/0018 |
| EP | 3875418 | A1 | * | 9/2021 | ..... B66B 5/06 |
| JP | 07-206309 | A | | 8/1995 | |
| JP | 2012-246073 | A | | 12/2012 | |
| JP | 2014-237536 | A | | 12/2014 | |
| JP | 2015-508367 | A | | 3/2015 | |
| JP | 2020070128 | A | * | 5/2020 | ..... B66B 5/06 |
| KR | 20150094787 | A | * | 4/2011 | |
| KR | 20170020440 | A | * | 9/2014 | |
| WO | 2005/115900 | A1 | | 12/2005 | |
| WO | WO-2007034587 | A1 | * | 3/2007 | ..... B66B 1/285 |
| WO | WO-2010071639 | A1 | * | 6/2010 | ..... B66B 1/32 |
| WO | WO-2010107407 | A1 | * | 9/2010 | ..... B66B 5/06 |
| WO | WO-2010107409 | A1 | * | 9/2010 | ..... B66B 5/044 |
| WO | WO-2013110693 | A1 | * | 8/2013 | ..... B66B 1/30 |
| WO | WO-2017103968 | A1 | * | 6/2017 | ..... B66B 1/3492 |
| WO | WO-2020090286 | A1 | * | 5/2020 | ..... B66B 5/06 |

* cited by examiner

CONTROL SYSTEM FOR ELEVATOR

TECHNICAL FIELD

The present relate to a control system for an elevator.

BACKGROUND ART

When the car of an elevator is placed in conditions in which it moves at an abnormally increased speed (which is hereinafter referred to as overspeed conditions) due to, inter alia, failure of a drive device or a control device, different sorts of safety devices are actuated step by step depending on a car speed to cause the car to stop automatically.

In a first stage, when the car speed is more than its rated speed and has exceeded a predetermined velocity (an overspeed velocity to be detected), the motor current of a hoist is cut off and, at the same time, the car is emergency braked by a brake installed in the hoist (an overspeed switch function).

In a second stage, when the car speed further increases and has exceeded an actuation velocity of emergency stop equipment because of, inter alia, breakage of a main rope, a braking mechanism attached to the car emergency brakes the car by clamping guide rails strongly (an emergency stop function).

Traditionally, a mechanical switch utilizing rotation of a governor has been used in a car speed detection device for actuating these safety devices. On the other hand, there is a detection method that implements detection of an abnormal car speed electrically using an encoder or an optical sensor. In this case, duplicated detection devices are used to ensure reliability; if the output values of both the detection devices do not match, it is regarded that a fault occurs in one of the detection devices and braking the car is performed accordingly. In a braking decision, if both the outputs of the detection devices are less than an actuation velocity corresponding to the overspeed velocity to be detected, the car will be moved to a nearby floor by controlling the hoist motor without applying the emergency stop equipment and passengers are allowed to get off the car. As a control system for an elevator, which is of this kind, is found in, e.g., PTL 1.

In PTL 1, a control device equipped with two acceleration sensors and a car speed detection device are installed in a car. Then, if a difference between the outputs of the two acceleration sensors is less than a predetermined threshold, an abnormality decision for the car speed detection device and a decision regarding application of braking means are made using acceleration data.

CITATION LIST

Patent Literature

PTL 1: Japanese Patent Application Laid-Open (Translation of PCT Application) No. 2015-508367

SUMMARY OF INVENTION

Technical Problem

According to a technology described in PTL 1, a decision regarding application of braking means is performed by utilizing the acceleration sensors attached to the car. However, when measurements are taken by the acceleration sensors installed to the car, an error occurs in output results of the acceleration sensors due to the influence of an inclination of the car, car vibration, noise, etc. When velocity data is calculated from thus measured acceleration data, a mismatch occurs between velocity data including an error and velocity data output by the car speed detection device and it is concerned that emergency stop of the car occurs frequently. In addition, because of applying emergency stop equipment depending on output velocity data, rapid deceleration occurs; this may give a burden to the mind and body of passengers. Therefore, there is a demand for a control system that makes an appropriate decision with regard to overspeed conditions of the car and application of braking means using output values of duplicated car speed detection devices.

An object of the present invention resides in solving a problem noted above and providing a control system for an elevator to reduce erroneous actuation of the emergency stop equipment.

Solution to Problem

To achieve the foregoing object, the present invention resides in a control system for an elevator including a car; a counterweight connected to the car by a main rope; a hoist having a motor for moving the car up and down; at least two car speed detection devices, namely, a first car speed detection device and a second car speed detection device to measure a moving speed of the car; a hoist brake to apply braking to the hoist; emergency stop equipment to brake the car by grasping guide rails laid along a moving path of the car; and a control device to control the hoist, the hoist brake, and the emergency stop equipment based on outputs of the first car speed detection device and the second car speed detection device. The control device includes a computing unit to calculate acceleration data of the car from velocity data from the first car speed detection device and the second car speed detection device and a decision unit to make a decision regarding an abnormally increased speed of the car. A feature of the invention is that if two pieces of velocity data that have been output from the first car speed detection device and the second car speed detection device respectively differ from one another and acceleration data of the car calculated from one that is higher of the two pieces of velocity data is equal to or more than a predetermined threshold, the decision unit decides that either the first car speed detection device or the second car speed detection device which has output the higher one of velocity data is abnormal.

Advantageous Effects of Invention

According to the present invention, it is possible to provide a control system for an elevator to reduce erroneous actuation of the emergency stop equipment.

DESCRIPTION OF EMBODIMENTS

Figure 1:
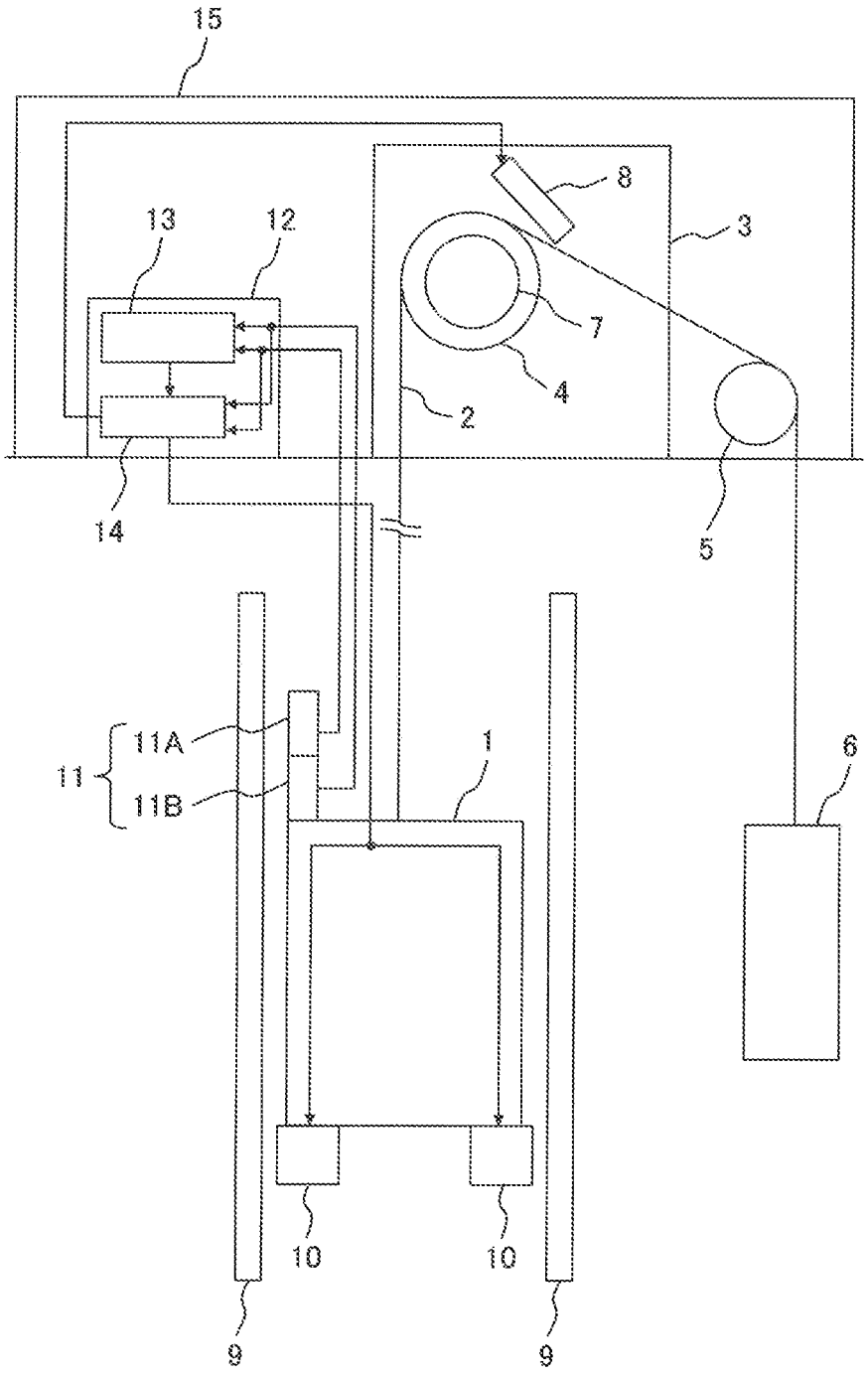
FIG. 1 is a schematic diagram depicting an overall structure of an elevator pertaining to one example of the present invention.

In the following, an example of the present invention is described with the drawings. FIG. 1 is a schematic diagram depicting an overall structure of an elevator pertaining to one example of the present invention. A car 1 is suspended by a main rope 2 and connected to a counterweight 6 via a sheave 4 and a pulley 5 constituting a hoist 3. The hoist 3 is equipped with a motor 7 to generate driving force and a hoist brake 8 to apply braking to the hoist. The car 1 moves along guide rails 9 through control of torque of a motor 7. The hoist 3 and the pulley 5 are installed within a machine room 15. In the machine room, a control device 12 which will be described later is provided.

The hoist brake 8 which is braking means is installed beside the motor 7 and actuated when a safety switch installed inside a hoistway has been turned off or when the speed of the car 1 has become equal to or more than an actuation velocity of an overspeed switch. When the hoist brake 8 is actuated, it brakes the car 1 by restraining the rotational motion of the hoist 3.

On the other hand, emergency stop equipment 10 which is braking means independent of the hoist brake 8 is installed in the car 1. The emergency stop equipment 10 is equipment for emergency stop of the car 1 when the car 1 does not decelerate even though the hoist brake 8 is actuated because of, inter alia, breakage of the main rope. When the emergency stop equipment 10 is actuated, a braking mechanism brakes the car 1 by grasping the guide rails 9 directly. Actuation of the overspeed switch and the emergency stop equipment 10 is based on velocity data from car speed detection devices 11. The actuation velocity of the emergency stop equipment 10 is greater than the actuation velocity of the overspeed switch due to their characteristics.

The car speed detection devices 11 are the devices to detect the moving speed of the car 1 and may be any of those that are capable of detecting a moving speed; e.g., cameras, optical sensors, magnetic sensors, etc. may be used as the devices or the devices may apply a method that calculates a moving speed from moving distance of the car 1. In addition, the car speed detection devices 11 may be installed in any location inside the hoistway, provided that they can output velocity data of the car 1 (installed on top of the car 1 in FIG. 1). In the present example, the car speed detection devices 11 are duplicated as system (a first car speed detection device 11A) and system 2 (a second car speed detection device 11B) and velocity data of the car 1 measured by each system is sent to the control device 12. In this way, the car speed detection devices 11 are duplicated in the present example and the embodiment is provided with the first car speed detection device 11A and the second car speed detection device 11B which are at least two car speed detection devices 11.

The control device 12 to implement control of the elevator includes a computing unit 13 and a decision unit 14. The computing unit 13 includes a memory to store velocity data sent from the car speed detection devices 11 and a computing device to calculate acceleration data of the car 1 from stored velocity data.

The decision unit 14 judges a state of the car 1 from output velocity data from the car speed detection devices 11 and acceleration data from the computing unit 13 and makes a decision regarding application of braking means. Note that, although the control device 12 is depicted to be installed inside the machine room 15 with the hoist 3 and the pulley 5 installed therein in FIG. 1, the control device 12 may be installed in any location inside the hoistway, provided that it can receive output values from the car speed detection devices 11 and send an actuation command to braking equipment.

Figure 2:
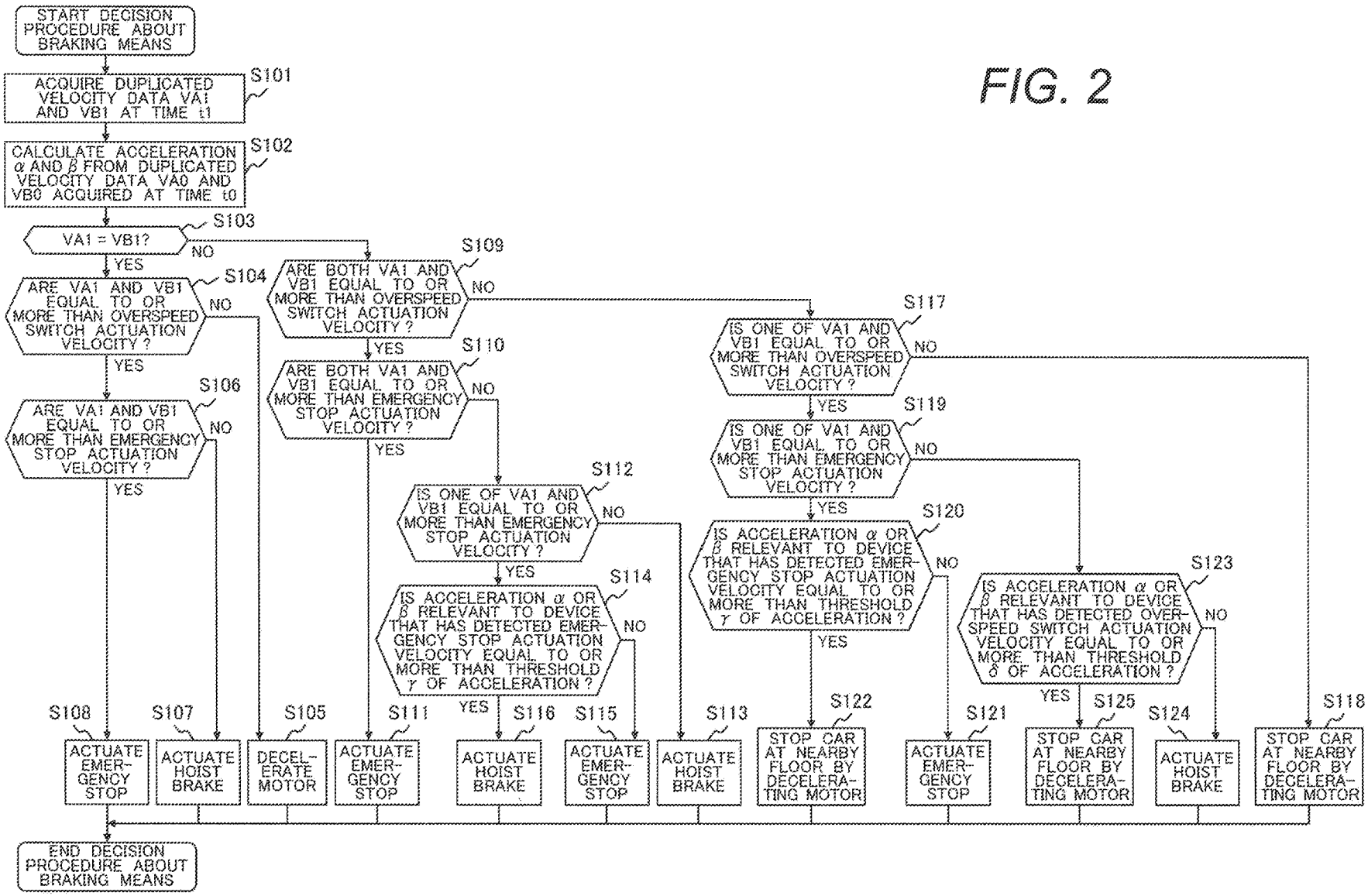
FIG. 2 is a flowchart illustrating a process to make a decision regarding application of the elevator braking means pertaining to one example of the present invention.

FIG. 2 is a flowchart illustrating a process to make a decision regarding application of the elevator braking means pertaining to one example of the present invention. A method for making a decision regarding application of the elevator braking means is described with this flowchart.

Simultaneously with when the control device 12 starts a decision procedure regarding application of the braking means, the car speed detection devices 11 acquire velocity data VA1 and VB1 of the car 1 at a time t1 (step S101). Acquired velocity data VA1 and VB1 of the car 1 are sent to the computing unit 13 and stored into the memory. From velocity data VA0 and VB0 of the car acquired at one measurement period before time t1 (at time t0) and stored in the computing unit 13 and the velocity data VA1 and VB1 stored in the computing unit 13, the computing unit then calculates acceleration data $\alpha$ and $\beta$ of the car, for example, by differentiating the velocity data (step S102). Note that calculated acceleration data $\alpha$ and $\beta$ of the car are stored into the memory internal to the computing unit 13 and sent to the decision unit 14.

The decision unit 14 decides whether the car 1 moves at an abnormally increased speed and makes a decision regarding application of the braking means of the car 1, using velocity data VA1 and VB1 output from the car speed detection devices 11 and acceleration data $\alpha$ and $\beta$ output from the computing unit 13 and in accordance with conditional branches below. Note that conditional branches in the flowchart in FIG. 2 are defined for a condition as follows: proceeding to a YES branch means that the condition is true and proceeding to a NO branch means that the condition is false.

If a match occurs between two pieces of velocity data VA1 and VB1 of the car (true at a conditional step S103), the decision unit 14 makes a decision regarding application of the braking means depending on the output car speed. If the velocity data VA1 and VB1 of the car are less than the actuation velocity of the overspeed switch (false at a conditional step S104), the decision unit 14 decides that the elevator is placed in a normal operation state. When decelerating the car 1, the control device brakes the car 1 by controlling the motor torque (step S105).

If, at the step S104, the velocity data VA1 and VB1 of the car are equal to or more than the actuation velocity of the overspeed switch (true at the conditional step S104) and less than the actuation velocity of the emergency stop equipment 10 (false at a conditional step S106), the decision unit 14 decides that the car 1 has reached the actuation velocity of the overspeed switch and the control device brakes the car 1 using the hoist brake 8 (step S107).

If, at the step S106, the velocity data VA1 and VB1 of the car are equal to or more than the actuation velocity of the emergency stop equipment 10 (true at the conditional step S106), the decision unit 14 decides that the car 1 has reached the actuation velocity of the emergency stop equipment 10 and the control device brakes the car 1 using the equipment 10 (step S108).

Note that there is a possibility that the car 1 does not decelerate by applying the braking means decided according to the conditional branches depending on an abnormal state of the car 1. For instance, in the event that the main rope 2 linked to the car 1 breaks, it is impossible to brake the car 1 even by controlling the motor torque and by applying the hoist brake 8. Therefore, a decision regarding application of the braking means is performed every measurement period (e.g., 1 to 2 ms) of the car speed detection devices 11; if the car 1 does not decelerate, the braking means should be changed depending on the car speed.

Then, a description is provided for a case in which a mismatch occurs between the two pieces of velocity data VA1 and VB1 of the car (false at the conditional step S103). When a mismatch occurs between the outputs of the duplicated car speed detection devices 11, a decision is made that at least one of the car speed detection devices 11 malfunctions and the control device brakes the car 1 according to conditional branches described below.

If both velocity data VA1 and VB1 of the car are equal to or more than the actuation velocity of the overspeed switch (true at a conditional step S109), the decision unit 14 further decides whether both velocity data VA1 and VB1 of the car are equal to or more than the actuation velocity of the emergency stop equipment 10 (a conditional step S110). If both velocity data VA1 and VB1 of the car are equal to or more than the actuation velocity of the emergency stop equipment 10 (true at the conditional step S110), the decision unit 14 decides that the car 1 has reached the emergency stop actuation velocity and the control device brakes the car 1 using the emergency stop equipment 10 (step S111).

If, at the step S110, at least one of the velocity data VA1 and VB1 of the car is less than the emergency stop actuation velocity (false at the conditional step S110), the decision unit 14 decides whether one of the velocity data VA1 and VB1 of the car is equal to or more than the actuation velocity of the emergency stop equipment 10 (a condition 112). If both velocity data VA1 and VB1 of the car are less than the actuation velocity of the emergency stop equipment 10 (false at a conditional step S112), the decision unit 14 decides that the car 1 has reached the actuation velocity of the overspeed switch and the control device brakes the car 1 using the hoist brake 8 (step S113). If one of the velocity data VA1 and VB1 of the car is equal to or more than the actuation velocity of the emergency stop equipment 10 (true at the conditional step S112), the decision unit 14 makes a decision regarding application of the braking means using acceleration data $\alpha$ or $\beta$ relevant to the car speed detection device 11 that has output the actuation velocity of the emergency stop equipment 10 (a conditional step S114).

Figure 3:
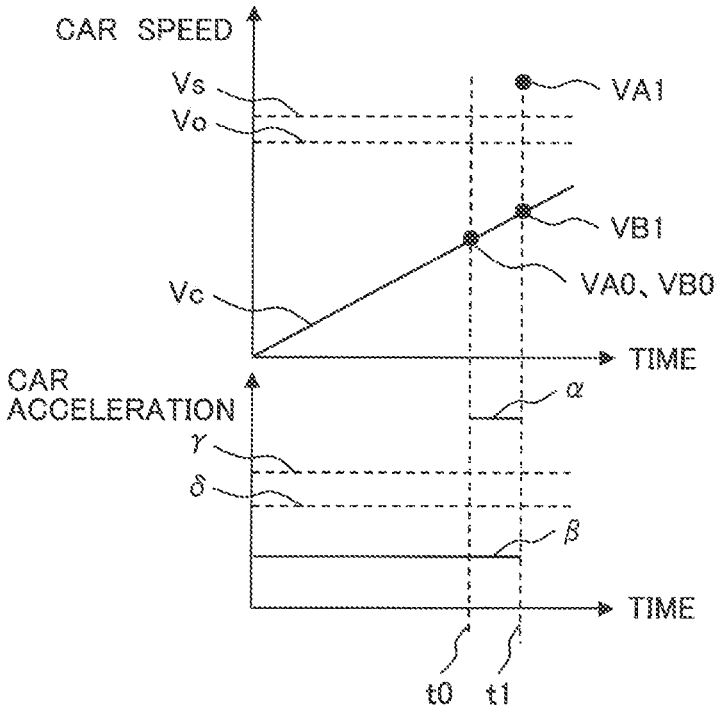
FIG. 3 is a transition chart of the car speed and acceleration of the car to explain a method for making a decision regarding application of the braking means when a mismatch occurs between duplicated pieces of velocity data of the car.

Here, using FIG. 3, a description is provided on a method for making a decision regarding application of the braking means by acceleration data. FIG. 3 is a transition chart of the car speed and acceleration of the car to explain the method for making a decision regarding application of the braking means when a mismatch occurs between duplicated pieces of velocity data of the car. FIG. 3 graphically presents the car speed and acceleration of the car on the assumption that the output value VA1 of the first car speed detection device 11A at time t1 is greater than the emergency stop actuation velocity Vs. In FIG. 3, Vc is the real speed of the car 1, VA0 and VB0 are the output values of the first car speed detection device 11A and the second car speed detection device 11B at time t0, VA1 and VB1 are the output values of the first car speed detection device 11A and the second car speed detection device 11B at time t1, Vo is the actuation velocity of the overspeed switch, $\alpha$ and $\beta$ are acceleration values of the car computed using the output values of the first car speed detection device 11A and the second car speed detection device 11B, $\delta$ is a threshold of acceleration for making a decision regarding activation of the overspeed switch, and $\gamma$ is a threshold of acceleration for making a decision regarding activation of the emergency stop equipment 10. While the first car speed detection device 11A outputs a value (velocity data VA1 of the car) that is more than the actuation velocity of the emergency stop equipment 10 at time t1, a match occurs between the output values of the two speed detection devices at time t0; it can be regarded that these devices can measure the car speed normally. Here, from velocity data VA0 and VA1 that have been output by the first car speed detection device 11A, a calculation is made of acceleration of the car between time t0 and t1. The elevator moves along the guide rails 9 inside the hoistway and it cannot happen that the elevator moves faster than a certain threshold of acceleration even under failure conditions to actuate the emergency stop equipment 10, e.g., inter alia, in the event that the car 1 falls because of breakage of the main rope. Therefore, the decision unit 14 sets in advance the threshold $\gamma$ at or above a maximum value of acceleration at which the car 1 can move under failure conditions to actuate the emergency stop equipment 10. Here, the threshold $\gamma$ of acceleration is set to a value that is equal to or more than acceleration of free fall on the assumption that the car 1 falls. When acceleration data $\alpha$ of the car is equal to or more than the predetermined threshold $\gamma$ when the emergency stop actuation velocity has been exceeded, it indicates that the car 1 accelerates at acceleration that the car never reaches in light of the elevator mechanism. It can be decided that a fault occurs in the first car speed detection device 11A that has output the velocity data. In this case, the control device brakes the car 1 by controlling the motor torque or applying the hoist brake 8 without actuating the emergency stop equipment 10.

In addition, considering a case in which the output of one of the car speed detection devices 11 is equal to or more than the actuation velocity of the overspeed switch and less than the actuation velocity of the emergency stop equipment 10 and the output of the other is less than the actuation velocity of the overspeed switch, a threshold $\delta$ of acceleration for making a decision regarding actuation of the overspeed switch is set in advance. The threshold $\delta$ of acceleration is set at or above the maximum acceleration that is generated by a total of the motor torque and torque attributed to weight difference between the car 1 and the counterweight 6 on the assumption that abnormality has occurred in the motor control. As is the case of means for making a decision regarding actuation of the emergency stop equipment 10, noted previously, in respect of the car speed detection device 11 that has output the actuation velocity of the overspeed switch, a calculation is made of acceleration of the car and, by comparing a result with the predetermined threshold $\delta$ of acceleration, it is decided as to whether a fault occurs. Note that a decision regarding application of the braking means is performed every measurement period of the car speed detection devices 11 and such decision is performed, as appropriate, if the car 1 does not decelerate.

Meanwhile, on the assumption that abnormality has occurred in velocity data from the car speed detection devices 11 due to, inter alia, spike noise, if calculated acceleration of the car has exceeded a predetermined threshold $\varepsilon$ of acceleration, it is also possible that the control device waits for a predetermined time without braking the car and makes a decision regarding application of the braking means again. Here, the threshold $\varepsilon$ of acceleration is set to a value greater than the thresholds $\gamma$ and $\delta$ of acceleration on the assumption that acceleration data rapidly increases due to noise.

By the decision method described above, the decision unit 14 decides to apply what braking means of the car 1. Returning to FIG. 2, if acceleration data α or β relevant to the car speed detection device 11 that has output the emergency stop actuation velocity is less than the predetermined threshold γ of acceleration (false at the conditional step S114), it is possible that the car speed detection device 11 that has output the emergency stop actuation velocity operates normally and, therefore, the control device brakes the car 1 by applying the emergency stop equipment 10 (step S115).

Otherwise, if acceleration data α or β relevant to the car speed detection device 11 that has output the emergency stop actuation velocity is equal to or more than the predetermined threshold γ of acceleration (true at the conditional step S114), the decision unit 14 decides that a fault occurs in the car speed detection device 11 that has output the emergency stop actuation velocity and the control device brakes the car 1 by applying the hoist brake 8 instead of the emergency stop equipment 10 (step S116). That is, when one of the velocity data VA1 and VB1 that have been output from the first car speed detection device 11A and the second car speed detection device 11B respectively is equal to or more than the actuation velocity of the emergency stop equipment 10 and the other is equal to or more than the actuation velocity for applying the hoist brake 8 and less than the actuation velocity of the emergency stop equipment 10, and if acceleration of the car 1 calculated from the higher one of velocity data is equal to or more than the predetermined threshold, the control device brakes the car 1 by actuating the hoist brake 8.

According to conditional branches above, the decision unit 14 can decide to apply what braking means in the case that velocity data VA1 and VB1 of the car differ from one another (false at the conditional step S103) and both velocity data VA1 and VB1 of the car which have been output are equal to or more than the overspeed switch actuation velocity (true at the conditional step S109).

Then, a description is provided about the decision method in the case that at least one of the velocity data VA1 and VB1 of the car is less than the actuation velocity of the overspeed switch (false at the conditional step S109). For this case, the decision unit 14 decides whether one of the velocity data VA1 and VB1 of the car is equal to or more than the actuation velocity of the overspeed switch (a conditional step S117). If both velocity data VA1 and VB1 of the car are less than the actuation velocity of the overspeed switch (false at the conditional step S117), the decision unit 14 decides that a fault occurs in at least one of the car speed detection devices 11, though the speed of the car 1 is less than the actuation velocity of the overspeed switch and the control device stops the car at a nearby floor by decelerating the motor (step S118).

If one of the velocity data VA1 and VB1 of the car is equal to or more than the actuation velocity of the overspeed switch (true at the conditional step S117), the decision unit 14 then decides whether one of the velocity data VA1 and VB1 of the car is equal to or more than the actuation velocity of the emergency stop equipment 10 (a conditional step S119). That is, the decision unit 14 decides whether one that is higher of velocity data VA1 and VB1 of the car is equal to or more than the actuation velocity of the emergency stop equipment 10. If one of the velocity data VA1 and VB1 of the car is equal to or more than the actuation velocity of the emergency stop equipment (true at the conditional step S119), the decision unit 14 makes a decision regarding application of the braking means using acceleration data α or β relevant to the car speed detection device 11 that has output the emergency stop actuation velocity (a conditional step S120).

If acceleration data α or β relevant to the car speed detection device 11 that has output the actuation velocity of the emergency stop equipment 10 is less than the predetermined threshold γ of acceleration (false at the conditional step S120), it is possible that the car speed detection device 11 that has output the emergency stop actuation velocity operates normally and, therefore, the control device brakes the car 1 by applying the emergency stop equipment 10 (step S121).

Otherwise, If acceleration data α or β relevant to the car speed detection device 11 that has output the emergency stop actuation velocity is equal to or more than the predetermined threshold γ of acceleration (true at the conditional step S120), the decision unit 14 decides that a fault occurs in the car speed detection device 11 that has output the emergency stop actuation velocity and the control device stops the car at a nearby floor by decelerating the motor instead of applying the emergency stop equipment 10 (step S122). That is, if acceleration of the car calculated from one that is higher of velocity data VA1 and VB1 of the car is equal to or more than the predetermined threshold, the decision unit 14 decides that either the first car speed detection device 11A or the second car speed detection device 11B which has output the higher one of velocity data is abnormal. Then, the control device stops the car 1 at a nearby floor by controlling the motor toque of the hoist 3.

If one of the velocity data VA1 and VB1 of the car is less than the actuation velocity of the emergency stop equipment 10 (false at the conditional step S119), that is, if one velocity data of the car is equal to or more than the actuation velocity of the overspeed switch and less than the actuation velocity of the emergency stop equipment 10, the decision unit 14 makes a decision regarding application of the braking means using acceleration data α or β relevant to the car speed detection device 11 that has output the overspeed switch actuation velocity (a conditional step S123).

If acceleration data α or β relevant to the car speed detection device 11 that has output the overspeed switch actuation velocity is less than the predetermined threshold δ of acceleration (false at the conditional step S123), it is possible that the car speed detection device 11 that has output the overspeed switch actuation velocity operates normally and, therefore, the control device brakes the car 1 by applying the hoist brake 8 (step S124).

Otherwise, if acceleration data α or β relevant to the car speed detection device 11 that has output the overspeed switch actuation velocity is equal to or more than the predetermined threshold δ of acceleration (true at the conditional step S123), the decision unit 14 decides that a fault occurs in the car speed detection device 11 that has output the overspeed switch actuation velocity and the control device stops the car at a nearby floor by decelerating the motor instated of applying the hoist brake (step S125). That is, when one of the velocity data VA1 and VB1 that have been output from the first car speed detection device 11A and the second car speed detection device 11B respectively is equal to or more than the actuation velocity for applying the hoist brake 8 and less than the emergency stop actuation velocity and the other is less than the actuation velocity for applying the hoist brake 8, and if acceleration of the car 1 calculated from the higher one of velocity data is equal to or more than the predetermined threshold, the control device stops the car 1 at a nearby floor by controlling the motor toque of the hoist 3.

As described hereinbefore, according to the present example, it is possible to decide to apply what braking means depending on overspeed conditions of the car 1 by utilizing velocity data of the car having been output from the duplicated car speed detection devices 11 and acceleration data of the car calculated by the computing unit 13. Therefore, it is possible to restrain erroneous activation of the emergency stop equipment.

REFERENCE SIGNS LIST

1 . . . car, 2 . . . main rope, 3 . . . hoist, 4 . . . sheave, 5 . . . pulley, 6 . . . counterweight, 7 . . . motor, 8 . . . hoist brake, 9 . . . guide rails, 10 . . . emergency stop equipment, 11 . . . car speed detection devices, 11A . . . first car speed detection device, 11B . . . second car speed detection device, 12 . . . control device, 13 . . . computing unit, 14 . . . decision unit, 15 . . . machine room.

The invention claimed is:

1. A control system for an elevator, comprising:

a car;

a counterweight connected to the car by a main rope;

a hoist having a motor for moving the car up and down;

at least two car speed detection devices, including a first car speed detection device and a second car speed detection device to measure a moving speed of the car;

a hoist brake to apply braking to the hoist;

emergency stop equipment to brake the car by grasping guide rails laid along a moving path of the car; and a control device to control the hoist, the hoist brake, and the emergency stop equipment based on outputs of the first car speed detection device and the second car speed detection device, wherein the control device including a computing unit to calculate acceleration data of the car from velocity data from the first car speed detection device and the second car speed detection device and a decision unit to make a decision regarding an abnormal increase in speed of the car, wherein, if two pieces of velocity data that have been output from the first car speed detection device and the second car speed detection device respectively differ from one another and acceleration data of the car calculated from one that is higher of the two pieces of velocity data is equal to or more than a predetermined threshold, the decision unit decides that either the first car speed detection device or the second car speed detection device which has output the higher one of velocity data is abnormal, wherein the emergency stop equipment is actuated at an actuation velocity that is greater than an actuation velocity to actuate the hoist break, and wherein when one of the two pieces of velocity data that have been output from the first car speed detection device and the second car speed detection device respectively is equal to or more than the actuation velocity of the emergency stop equipment and the other is equal to or more than an actuation velocity for applying the hoist break and less than the actuation velocity of the emergency stop equipment, and if acceleration of the car calculated from the higher one of velocity data is equal to or more than a predetermined threshold, the control device brakes the car by actuating the hoist brake.

2. The control system for an elevator according to claim 1, wherein when one of the two pieces of velocity data that have been output from the first car speed detection device and the second car speed detection device respectively is equal to or more than the actuation velocity of the emergency stop equipment and the other is less than the actuation velocity for applying the hoist break, and if acceleration of the car calculated from the higher one of velocity data is equal to or more than a predetermined threshold, the control device stops the car at a nearby floor by controlling the motor toque of the hoist.

3. The control system for an elevator according to claim 1, wherein when one of the two pieces of velocity data that have been output from the first car speed detection device and the second car speed detection device respectively is equal to or more than the actuation velocity for applying the hoist brake and less than the emergency stop actuation velocity and the other is less than the actuation velocity for applying the hoist break, and if acceleration of the car calculated from the higher one of velocity data is equal to or more than a predetermined threshold, the control device stops the car at a nearby floor by controlling the motor toque of the hoist.

4. The control system for an elevator according to claim 1 wherein when one of the two pieces of velocity data that have been output from the first car speed detection device and the second car speed detection device respectively is equal to or more than the actuation velocity of the emergency stop equipment and the other is less than the actuation velocity of the emergency stop equipment, a threshold of acceleration against which acceleration of the car calculated from the higher one of velocity data is compared is set equal to or more than free fall acceleration.

5. The control system for an elevator according to claim 1, wherein when one of the two pieces of velocity data that have been output from the first car speed detection device and the second car speed detection device respectively is equal to or more than the actuation velocity for applying the hoist brake and the other is less than the actuation velocity for applying the hoist brake, a threshold of acceleration against which acceleration of the car calculated from the higher one of velocity data is compared is set equal to or more than maximum acceleration that is generated by a total of the motor torque of the hoist and torque attributed to weight difference between the car and the counterweight.

6. The control system for an elevator according to claim 1, wherein if two pieces of velocity data that have been output from the first car speed detection device and the second car speed detection device respectively differ from one another and acceleration of the car calculated from one that is higher of the two pieces of velocity data is equal to or more than a predetermined threshold, the control device waits for a predetermined time without braking the car and makes a decision regarding application of braking means again.

* * * * *